US009587437B2

(12) United States Patent
Prill et al.

(10) Patent No.: US 9,587,437 B2
(45) Date of Patent: Mar. 7, 2017

(54) POWERED REAMING DEVICE

(71) Applicant: National Oilwell Varco, L.P., Houston, TX (US)

(72) Inventors: Jonathan Ryan Prill, Edmonton (CA); Alan Martyn Eddison, York (GB)

(73) Assignee: National Oilwell Varco, L.P., Houston, TX (US)

( * ) Notice: Subject to any disclaimer, the term of this patent is extended or adjusted under 35 U.S.C. 154(b) by 228 days.

(21) Appl. No.: 14/312,580

(22) Filed: Jun. 23, 2014

(65) Prior Publication Data

US 2015/0368978 A1 Dec. 24, 2015

(51) Int. Cl.

| | |
|---|---|
| ***E21B 10/26*** | (2006.01) |
| ***E21B 4/02*** | (2006.01) |
| ***E21B 17/10*** | (2006.01) |
| ***E21B 7/28*** | (2006.01) |
| ***E21B 17/18*** | (2006.01) |

(52) U.S. Cl.

CPC ..... *E21B 10/26* (2013.01); *E21B 4/02* (2013.01); *E21B 7/28* (2013.01); *E21B 17/1078* (2013.01); *E21B 17/18* (2013.01)

(58) Field of Classification Search

USPC ..... 175/55

See application file for complete search history.

(56) References Cited

U.S. PATENT DOCUMENTS

| | | | |
|---|---|---|---|
| 4,270,618 | A | 6/1981 | Owens |
| 4,365,677 | A | 12/1982 | Owens |
| 4,646,856 | A | 3/1987 | Dismukes |
| 5,308,150 | A | 5/1994 | Whitehouse |
| 6,059,051 | A | 5/2000 | Jewkes et al. |
| 6,446,737 | B1 | 9/2002 | Fontana et al. |
| 6,470,977 | B1 | 10/2002 | Chen et al. |
| 7,350,596 | B1 | 4/2008 | Attaya |
| 7,497,279 | B2 | 3/2009 | Hall et al. |
| 7,513,318 | B2 | 4/2009 | Underwood et al. |
| 2012/0279784 | A1 | 11/2012 | Harvey et al. |
| 2013/0313022 | A1 | 11/2013 | Kirkhope et al. |

FOREIGN PATENT DOCUMENTS

| | | |
|---|---|---|
| CN | 102373885 | 3/2012 |
| KR | 101072232 | 10/2011 |
| WO | 2013167954 | 11/2013 |

OTHER PUBLICATIONS

Search Report and Written Opinion dated Aug. 21, 2015 for corresponding application PCT/US2015/034898; 9pgs.

*Primary Examiner* — Taras P Bemko

(74) *Attorney, Agent, or Firm* — Derek V. Forinash; Porter Hedges LLP

(57) ABSTRACT

A powered reamer comprising a stationary assembly having a flow bore therethrough. A rotating assembly is disposed about the stationary assembly and one or more cutting structures are coupled to an outer surface of the rotating assembly. A flow restriction is disposed within the flow bore so as to divert a portion of fluid flowing through the flow bore through an outlet from the flow bore into an annulus between the stationary assembly and the rotating assembly. A power section is formed in the annulus between the stationary assembly and the rotating assembly. The power section operates to eccentrically rotate the rotating assembly about the stationary assembly in response to fluid flowing through the annulus between the stationary assembly and the rotating assembly.

17 Claims, 3 Drawing Sheets

POWERED REAMING DEVICE

CROSS-REFERENCE TO RELATED APPLICATIONS

None

BACKGROUND

This disclosure relates generally to methods and apparatus for drilling wellbores. More specifically, this disclosure relates to methods and apparatus for increasing the diameter of a wellbore through reaming operations. Still more specifically, this disclosure relates to increasing the diameter of a wellbore without rotating the drill string.

In drilling a wellbore into the earth, such as for the recovery of hydrocarbons, a drill bit is connected onto the lower end of an assembly of drill pipe sections known as a drill string. The drill string is rotated so that the drill bit progresses downward into the earth to create the desired wellbore. In certain applications, such as the drilling of deviated or horizontal wellbores, the drill string is not rotated and downhole motors are used to rotate the drill bit. The downhole motors are often powered by pressurized drilling fluid pumped through the drill string. In addition to providing a conduit for the supply of pressurized fluid, the drill string may not rotate but can be used to transfer torque to lower end of the drill string, known as the bottom hole assembly, to help guide the path of the drill bit as it forms the wellbore.

During drilling, cuttings produced from the formation are carried away from the drill bit by the upward velocity of the drilling fluid. As the wellbore becomes more deviated from vertical, gravitational forces decrease the ability of the drilling fluid to carry cuttings out of the wellbore and the cuttings may settle along the bottom side of the wellbore. Settled cuttings, and the friction generated by the drill string contacting the bottom side of the wellbore can significantly increase the drag forces on the drill string.

In many drilling applications, the wellbore may need to be enlarged after it is initially drilled. This process is known as reaming. Reaming may be used to enlarge a section of the hole that was drilled too small, to open a section of wellbore, to remove an obstruction or dogleg from the wellbore, or any number of other operational reasons. Most conventional reamers are operated by rotating the drill string and therefore cannot be used in highly deviated wellbores or with systems that don't allow for rotating the drill string.

Thus, there is a continuing need in the art for methods and apparatus for methods and apparatus to enlarge a wellbore using a reamer.

BRIEF SUMMARY OF THE DISCLOSURE

A powered reamer comprising a stationary assembly having a flow bore therethrough. A rotating assembly is disposed about the stationary assembly and one or more cutting structures are coupled to an outer surface of the rotating assembly. A flow restriction is disposed within the flow bore so as to divert a portion of fluid flowing through the flow bore through an outlet from the flow bore into an annulus between the stationary assembly and the rotating assembly. A power section is formed in the annulus between the stationary assembly and the rotating assembly. The power section operates to eccentrically rotate the rotating assembly about the stationary assembly in response to fluid flowing through the annulus between the stationary assembly and the rotating assembly.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
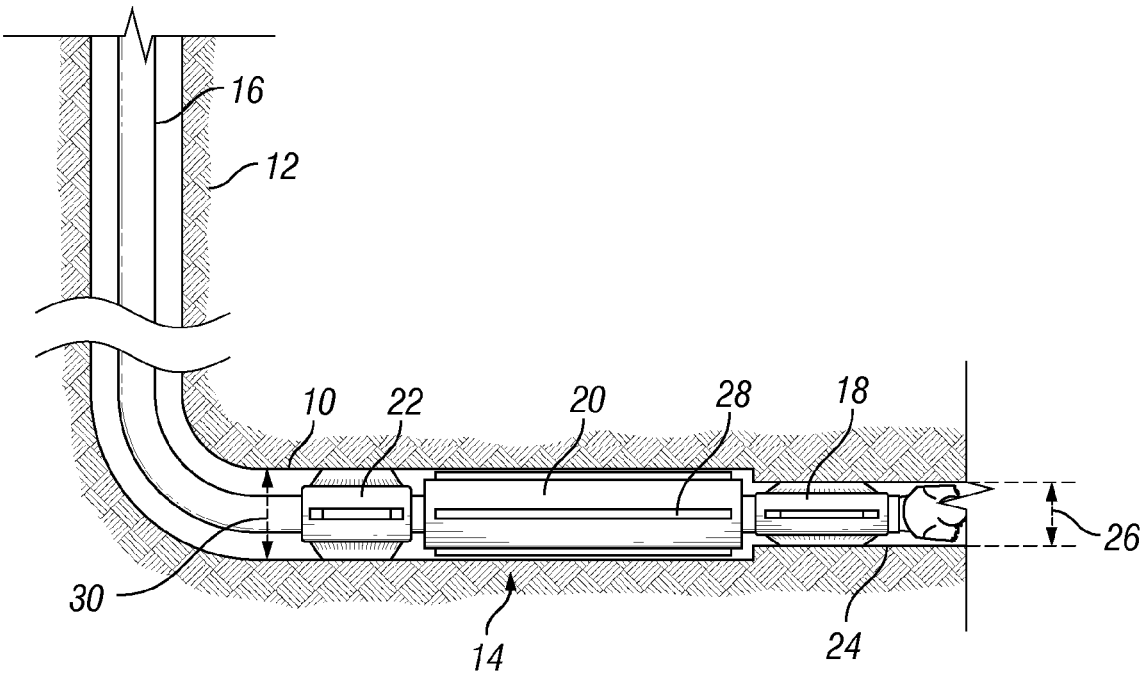
FIG. 1 is a partial sectional schematic view of a wellbore.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a wellbore 10 is formed in a formation 12. A powered reaming assembly 14 is coupled to a drill string 16 and disposed within the wellbore 10. The powered reaming assembly 14 includes a lower stabilizer 18, a powered reamer 20, and an upper stabilizer 22. In operation, the powered reaming assembly 14 is run into the wellbore 10 so that the lower stabilizer 18 is disposed within an un-reamed wellbore portion 24 that has a first gauge diameter 26. Once in position, the powered reamer 20 is activated and reamer blades 28 will rotate and cut into the formation 12. As the powered reamer 20 is operated the powered reaming assembly 14 is lowered further into the wellbore 10 and the powered reamer 20 will increase the diameter of the un-reamed wellbore portion 24 to a second gauge diameter 30 that is larger than the first gauge diameter 26.

As the powered reamer 20 operates the lower stabilizer 18 and upper stabilizer 22 act to center the powered reamer 20 within the wellbore 10 so as to provide circumferential stability to the wellbore 10. In order to center the powered reamer 20, the lower stabilizer 18 is sized so as to closely engage the first gauge diameter 26 of the un-reamed wellbore portion 24. Similarly, the upper stabilizer 22 is sized so as to closely engage the second gauge diameter 30 of the wellbore 10. This close engagement allows the powered reaming assembly 14 to move axially through the wellbore 10 while minimizing radial movement within the wellbore 10.

Figure 2:
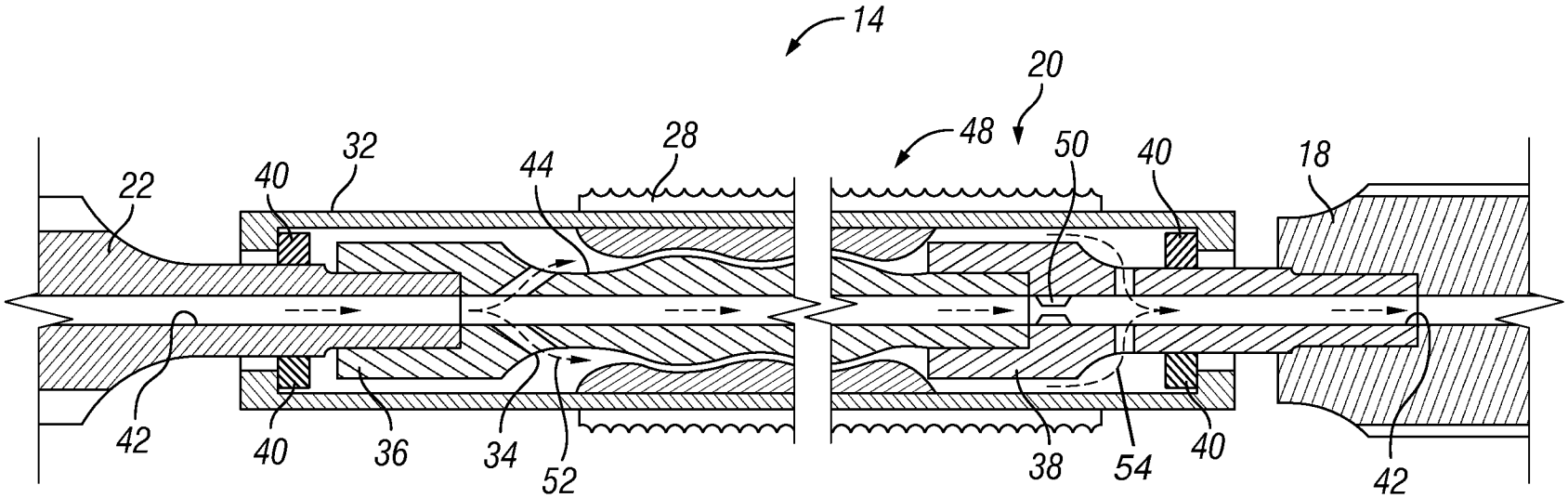
FIG. 2 is a partial sectional view of a powered reaming device.

Referring now to FIG. 2, the powered reamer 20 includes a plurality of reamer blades 28 coupled to rotating assembly 32. The rotating assembly 32 is disposed about a stationary assembly 34 that includes a power mandrel 36 and a flow mandrel 38. Seal assemblies 40 are disposed between the rotating assembly 32 and the stationary assembly 34. The upper stabilizer 22, the power mandrel 36, the flow mandrel 38, and the lower stabilizer 18 are connected in series so that a central flow bore 42 is formed through the powered reaming assembly 14. The connection of the upper stabilizer 22, the power mandrel 36, the flow mandrel 38, and the lower stabilizer 18 also allows torque to be transmitted through the powered reaming assembly 14, which may be useful when it is desirable to rotate or transfer torque through the drill string 16. Being able to transfer torque along the drill string 16 may be useful in the operation of other components, such as steering tools, located along the drill string below the powered reaming assembly 14.

Figure 3:
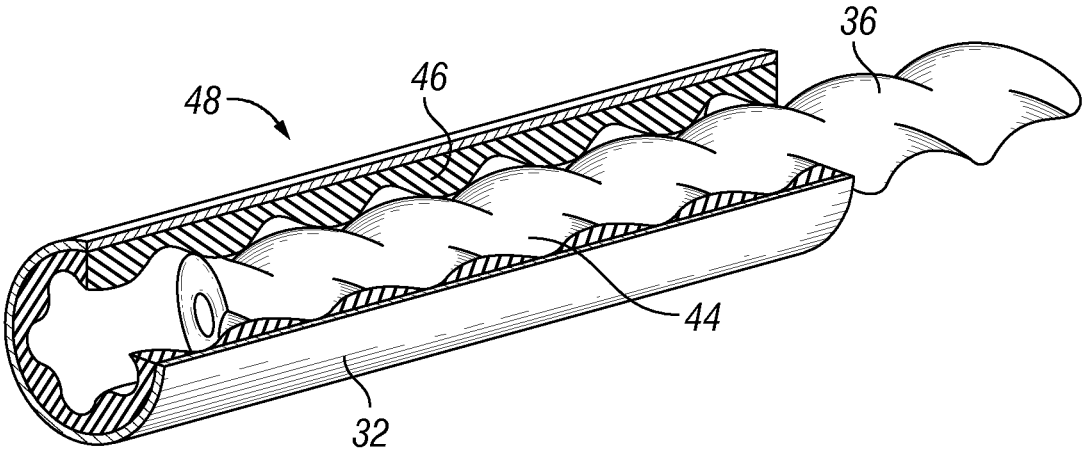
FIG. 3 is a partial sectional view of a positive displacement pump.
Figure 4:
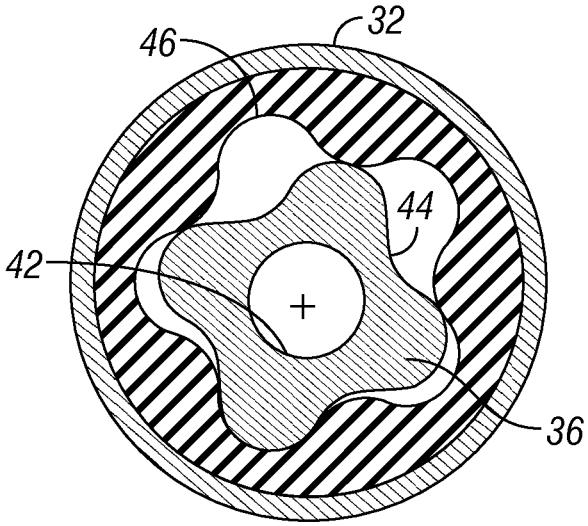
FIG. 4 is a partial sectional end view of a positive displacement pump.

Referring now to FIGS. 3 and 4, the power mandrel 36 includes an outer surface 44 having helical lobes such as those commonly found on the rotor of a positive displacement motor or a progressive cavity pump. The rotating assembly 32 includes a resilient sleeve 46 having helical grooves that accept the helical lobes on the outer surface 44 of the power mandrel 36. Thus, the outer surface 44 of the power mandrel 36 and the resilient sleeve 46 of the rotating assembly 32 form a power section 48 that will generate rotational motion in response to differential pressure and flow of fluid through the power section 48. In general terms, the power section 48 operates identical to a positive displacement motor or a progressive cavity pump except the outer portion rotates and the inner portion remains stationary.

Referring back to FIG. 2, pressurized fluid is supplied to central flow bore 42 of the powered reaming assembly 14 through a drill string (shown in FIG. 1). The flow of fluid through the flow bore 42 is limited by a flow restriction 50. The flow restriction 50 may be a nozzle, orifice, reduced diameter, or other feature that generates a differential pressure between outlets 52 and inlets 54. The flow restriction 50 is illustrated as being disposed in the flow mandrel 38 but it could be located at any position along the flow bore 42 between the outlets 52 and inlets 54. In certain embodiments, the flow restriction 50 may block the flow of fluid through the flow bore 42, thus forcing all of the fluid to flow through outlets 52 and through the power section 48.

In operation, fluid flows through the flow bore 42 into the power mandrel 36. A portion of the fluid flows through outlets 52 into the annulus between the rotating assembly 32 and the power mandrel 36. The flow that moves into the annulus moves through the power section 48, causing the rotating assembly 32 to eccentrically rotate about the stationary assembly 34. Once the fluid passes through the power section 48, it re-enters the flow bore 42 through inlets 54. The power section 48 may be configured such that the rotating assembly 32 rotates either clockwise or counter-clockwise about the stationary assembly 34. In certain embodiments, the rotation of the powered reamer 20 may be configured to rotate in a direction opposite the rotation of a drill bit disposed below the powered reaming assembly 14. The counter-rotation may be useful in decreasing the torque load on the drill string above the powered reaming assembly 14.

As can be seen in FIG. 4, as the power section 48 operates, the rotating assembly 32 is disposed eccentrically relative to the stationary assembly 34 due to the interface between the helical grooves and helical lobes. This interface will cause the rotating assembly 32 to eccentrically rotate about the stationary assembly 34. As the rotating assembly 32 rotates, the blades 28 will intermittently cut into the surrounding formation. In certain embodiments, the blades 28 may be stationary blades and include straight blades, helical blades, cutting pads, other cutting structures, and combinations thereof. In certain embodiments, the blades 28 may include extendable pads or arms that extend from the rotating assembly 32 and may allow for cutting a larger diameter wellbore. In certain embodiments, blades 28 may be replaced, or used in cooperation with, brushes, scrapers, and other wellbore cleaning features. In some embodiments, the rotating assembly 32 may include nozzles, or other flow ports, that allow some, or all, of the fluid into the annulus between the wellbore and the rotating assembly 32 so as to provide lubrication and/or help in the removal of cuttings from the wellbore.

Seal assemblies 40 limit the loss of fluid as it moves through the annulus between the rotating assembly 32 and the stationary assembly 34. In certain embodiments, seal assemblies 40 allow a certain portion of the fluid to bypass the seal assemblies 40 and flow into the annulus between the powered reaming assembly 14 and the surrounding wellbore 10 so as to provide lubrication and/or help in the removal of cuttings from the wellbore. In other embodiments, the seal assemblies 40 may retain substantially all of the fluid within the powered reaming device 14, which may allow other fluid powered tools to operated downstream of the powered reaming assembly 14. The seal assemblies 40 may be elastomeric seals, brush seals, tortuous flow seals, face seals, combinations thereof, or other seal configurations that allows eccentric rotation. Seal assemblies 40 may also act as bearings to support the axial thrust load on the rotating assembly 32 during reaming.

In certain embodiments, the upper stabilizer 22 may be omitted to allow the powered reaming assembly 14 to pass through a smaller inside diameter section of the wellbore before reaming a larger diameter section of the wellbore below. Alternatively, the upper stabilizer 22 can have a variable or adjustable gauge and be activated once the powered reaming assembly 14 is placed in position within the wellbore before the reaming operation commences and the variable gauge stabilizer can be extended to closely engage the wellbore from a clearance position immediately prior to the reaming operation. In other embodiments, upper stabilizer 22 may not be used at all and the powered reaming assembly 14 could be run with only the powered reamer 20 and the lower stabilizer 18.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A powered reamer comprising:

a stationary assembly having a flow bore there through;

a rotating assembly at least partially surrounding the stationary assembly;

one or more cutting structures coupled to an outer surface of the rotating assembly;

a flow restriction disposed within the flow bore so as to divert a portion of fluid flowing through the flow bore through an outlet from the flow bore into an annulus between the stationary assembly and the rotating assembly; and a power section formed in the annulus between the stationary assembly and the rotating assembly, wherein the power section operates to eccentrically rotate the rotating assembly around the stationary assembly in response to fluid flowing through the annulus between the stationary assembly and the rotating assembly, wherein the power section further comprises:

a helical lobe formed on an outer surface of the stationary assembly; and a helical groove formed in a resilient sleeve coupled to an inner surface of the rotating.

2. The powered reamer of claim 1, further comprising:

a drill string coupled to one end of the stationary assembly; and a lower stabilizer coupled to another end of the stationary assembly.

3. The powered reamer of claim 2, further comprising:

an upper stabilizer coupled to the drill string and to the stationary assembly, wherein the upper stabilizer has a larger outer diameter than the lower stabilizer.

4. The powered reamer of claim 1, further comprising seal assemblies disposed between the stationary assembly and the rotating assembly.

5. The powered reamer of claim 4, wherein the seal assemblies retain fluid within the annulus between the stationary assembly and the rotating assembly.

6. The powered reamer of claim 1, wherein the flow restriction diverts all of fluid flowing through the flow bore through an outlet from the flow bore into an annulus between the stationary assembly and the rotating assembly.

7. A powered reaming assembly comprising:

a drill string;

a powered reamer coupled to the drill string; and a lower stabilizer coupled to the powered reamer, wherein the powered reamer includes:

a rotating assembly operable to eccentrically rotate relative to the drill string and the lower stabilizer, wherein the rotating assembly forms a rotor of a positive displacement motor, and one or more cutting structures coupled to an outer surface of the rotating assembly.

8. The powered reaming assembly of claim 7, further comprising an upper stabilizer coupled to the drill string and to the powered reamer, wherein the upper stabilizer has a larger outer diameter than the lower stabilizer.

9. The powered reaming assembly of claim 8, wherein the powered reamer further comprises:

a stationary assembly coupled to the upper stabilizer and the lower stabilizer, wherein the rotating assembly at least partially surrounds the stationary assembly;

a flow bore disposed through the upper stabilizer, the stationary assembly, and the lower stabilizer;

a flow restriction disposed within the flow bore so as to divert a portion of fluid flowing through the flow bore through an outlet from the flow bore into an annulus between the stationary assembly and the rotating assembly; and a power section formed in the annulus between the stationary assembly and the rotating assembly, wherein the power section operates to eccentrically rotate the rotating assembly around the stationary assembly in response to fluid flowing through the annulus between the stationary assembly and the rotating assembly.

10. The powered reaming assembly of claim 9, wherein the power section further comprises:

a helical lobe formed on an outer surface of the stationary assembly; and a helical groove formed in a resilient sleeve coupled to an inner surface of the rotating assembly.

11. The powered reaming assembly of claim 9, further comprising seal assemblies disposed between the stationary assembly and the rotating assembly.

12. The powered reaming assembly of claim 11, wherein the seal assemblies retain fluid within the annulus between the stationary assembly and the rotating assembly.

13. The powered reaming assembly of claim 9, wherein the flow restriction diverts all of fluid flowing through the flow bore through an outlet from the flow bore into an annulus between the stationary assembly and the rotating assembly.

14. A method comprising:

constructing a powered reaming assembly by coupling a stationary assembly of a powered reamer to an upper stabilizer and a lower stabilizer, wherein the stationary assembly forms a non-rotating portion of a positive displacement motor;

coupling the upper stabilizer to a drill string;

lowering the powered reaming assembly and the drill string into a wellbore; and pumping fluid through the drill string to the powered reaming assembly so that a portion of the powered reamer eccentrically rotates relative to the upper stabilizer and the lower stabilizer, wherein the portion of the powered reamer that eccentrically rotates relative to the upper stabilizer and the lower stabilizer includes one or more cutting structures.

15. The method of claim 14, wherein the powered reaming assembly further comprises:

a rotating assembly at least partially surrounding the stationary assembly;

a flow bore disposed through the upper stabilizer, the stationary assembly, and the lower stabilizer;

a flow restriction disposed within the flow bore so as to divert a portion of fluid flowing through the flow bore through an outlet from the flow bore into an annulus between the stationary assembly and the rotating assembly; and a power section formed in the annulus between the stationary assembly and the rotating assembly, wherein the power section operates to eccentrically rotate the rotating assembly around the stationary assembly in response to fluid flowing through the annulus between the stationary assembly and the rotating assembly.

16. The method of claim 15, wherein the power section further comprises:

a helical lobe formed on an outer surface of the stationary assembly; and a helical groove formed in a resilient sleeve coupled to an inner surface of the rotating assembly.

17. The method of claim 14, wherein the upper stabilizer has a larger outer diameter than the lower stabilizer.

* * * * *